United States Patent [19]

Savarese

[11] Patent Number: 4,899,401

[45] Date of Patent: Feb. 13, 1990

[54] SYSTEM FOR PROVIDING HEATED AIR BUBBLES TO A SPA OR TUB

[76] Inventor: Robert Savarese, 5620 Funston St., Hollywood, Fla. 33023

[21] Appl. No.: 344,716

[22] Filed: Apr. 28, 1989

[51] Int. Cl.[4] ..... A61H 33/02

[52] U.S. Cl. ..... 4/542; 4/543; 4/544; 4/493; 128/66

[58] Field of Search ..... 4/542, 541, 543, 544, 4/507, 509, 493; 128/66

[56] References Cited

U.S. PATENT DOCUMENTS

| | | | |
|---|---|---|---|
| 3,411,163 | 11/1968 | Myers, Jr. | 4/493 X |
| 4,008,498 | 2/1977 | Thomas | 4/543 |
| 4,189,791 | 2/1980 | Dundas | 4/493 X |
| 4,325,149 | 4/1982 | Moreland | 4/542 X |
| 4,813,396 | 3/1989 | Sargeant et al. | 4/544 X |

FOREIGN PATENT DOCUMENTS

| | | | |
|---|---|---|---|
| 219730 | 4/1987 | European Pat. Off. | 4/542 |
| 2181643 | 4/1987 | United Kingdom | 4/542 |

*Primary Examiner*—Henry K. Artis

*Attorney, Agent, or Firm*—M. K. Silverman

[57] ABSTRACT

A system for providing heating air bubbles to a heated tub or spa positioned within a heated water circuit having heater and pump means. Included is an ambient air input conduit including a blower. Also included is a heat exchanger positioned within a fluid integral closet, the heat exchanger having a central fluid transfer coil and heat sink in thermal communication. The heat sink projects outwardly within the interior of the air closet, the air closet having as its input an output of said ambient air input conduit, the fluid transfer coil having as its input and output a by-pass of the hot water circuit. Further included in the system is an internal air conduit having as its input the output of said air closet and, as its output, the heated spa or tub. As such, the passage of heated water through the fluid transfer coil of heat exchanger will heat the heat sink means of exchanger to, in turn, communicate heat to the ambient air furnished to the air closet which, in turn, through the internal air conduit provides a heated air bubble input to the heated spa or tub.

6 Claims, 3 Drawing Sheets

SYSTEM FOR PROVIDING HEATED AIR BUBBLES TO A SPA OR TUB

BACKGROUND OF THE INVENTION

A long standing problem in the area of heated spas and tubs has been that when air is introduced into the water of the tub, typically in the form of bubbles, such air is at a temperature considerably below that of the water in the tub. Consequently, the parties using the tub will experience discomfort or irritation by cold air bubbles passing through hot water.

While the above problem could be solved by the provision of an independent supply of heated air, this approach is not cost-effective and the maintenance of such a system presents various problems.

To the knowledge of the inventor, there is not known in the art a system for providing heated air bubbles to a heated spa or tub in which the heat of the hot water itself is employed as the mechanism for heating air and air bubbles to be provided to the tub or spa.

SUMMARY OF THE INVENTION

The instant invention relates to a system providing heated air bubbles to a heated spa or tub positioned within a heated water circuit said circuit having pump and heater means positioned therein. The inventive system includes an ambient air input conduit including blower means therein. Further included is a heat exchanger positioned within a fluid integral air closet, said heat exchanger having a central fluid transfer coil and heat sink means in thermal communication therewith, said heat sink means projecting outwardly into the interior of said air closet, said air closet having as its input an output of said ambient air input conduit, the fluid transfer coil having as its input and output a by-pass of said hot water circuit. The system further includes an internal air conduit having as its input the output of said air closet and, as its output, said spa or tub. Through the passage of heated water from said by-pass through said fluid transfer coil, heat will communicate from said heat sink means to the air within said air closet thereby providing a heated air input to said internal air conduit and, thereby, an input to such said spa or tub.

It is accordingly an object of the present invention to provide an improved method and means for providing heated air bubbles to a heated spa or tub positioned within a heated water circuit as, typically, is used in a health club spa or in a jacuzzi.

It is another object of the present invention to provide an improved and cost-effective system whereby heated air bubbles may be provided to a heated water spa or tub.

The above and yet other objects and advantages of the present invention will become apparent in the hereinafter set forth detailed description of the invention, the drawings, and claims appended herewith.

DETAILED DESCRIPTION OF THE INVENTION

Figure 1:
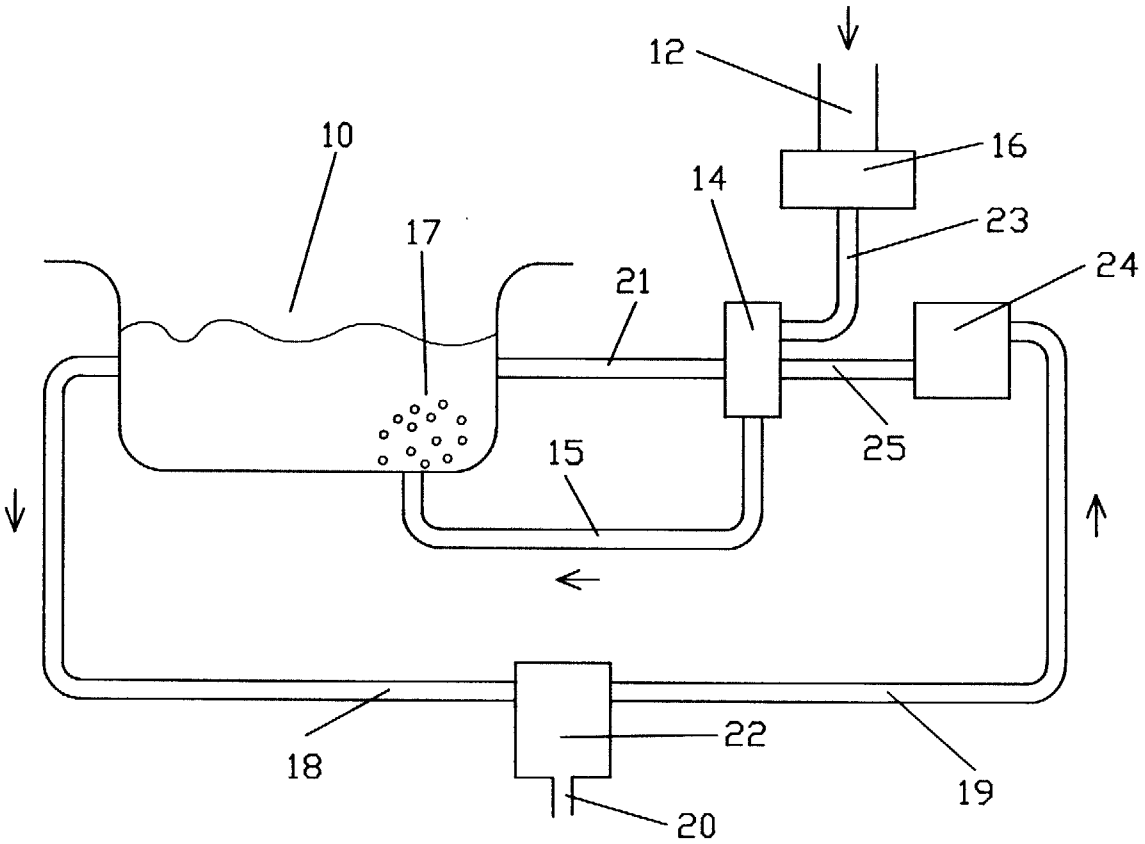
FIG. 1 is a schematic circuit diagram of the inventive system.

With reference to FIG. 1, it is seen that a heated spa or tub 10 is provided with a hot water circuit which includes conduit segment 18 downstream of the tub, a pump 22 having, associated therewith, an external water input 20, a conduit segment 19 downstream of pump 22, a heater 24, a conduit segment 25 downstream of heater 24, a heat exchanger 14 (more fully described below), and a water conduit segment 21 downstream of said heat exchanger 14, which comprises the heated water input to tub 10.

Further shown in the schematic circuit diagram of FIG. 1 is an ambient air input 12 and an air blower 16 which provides an air conduit 23 to heat exchanger 14. The heat exchanger and its associated hardware is more fully shown in the views of FIGS. 2 and 3. Therein, it may be noted that, from blower 16, ambient air is provided through conduit 23 to air closet 26 such that air passes over the fins of heat exchanger 14 and, thereafter, exits from the air closet through internal air conduit 15, ultimately exiting as bubbles 17 within the water of tub 10.

Figure 2:
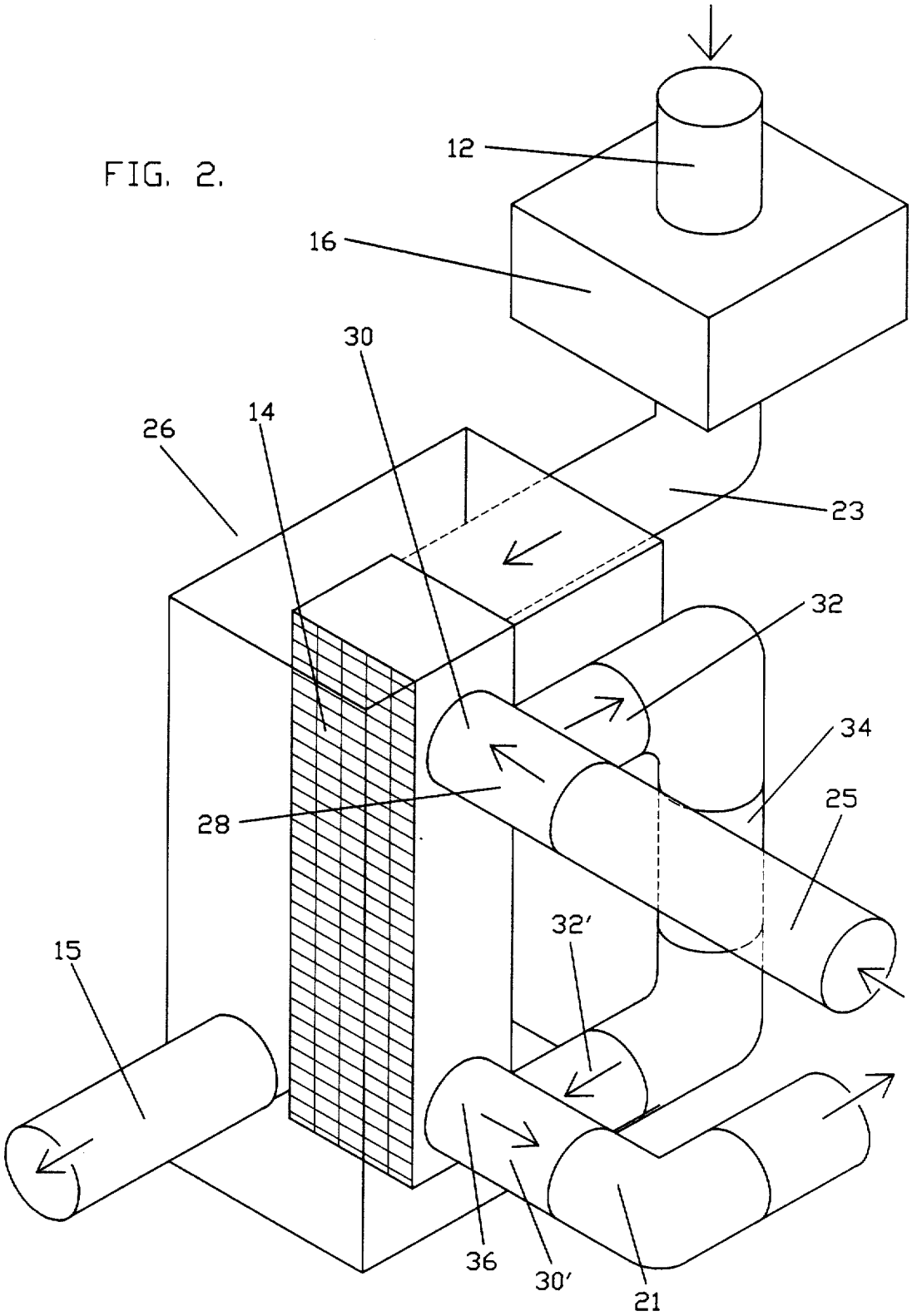
FIG. 2 is an isometric schematic of the heat exchanger component and water bypass conduit of the system.
Figure 3:
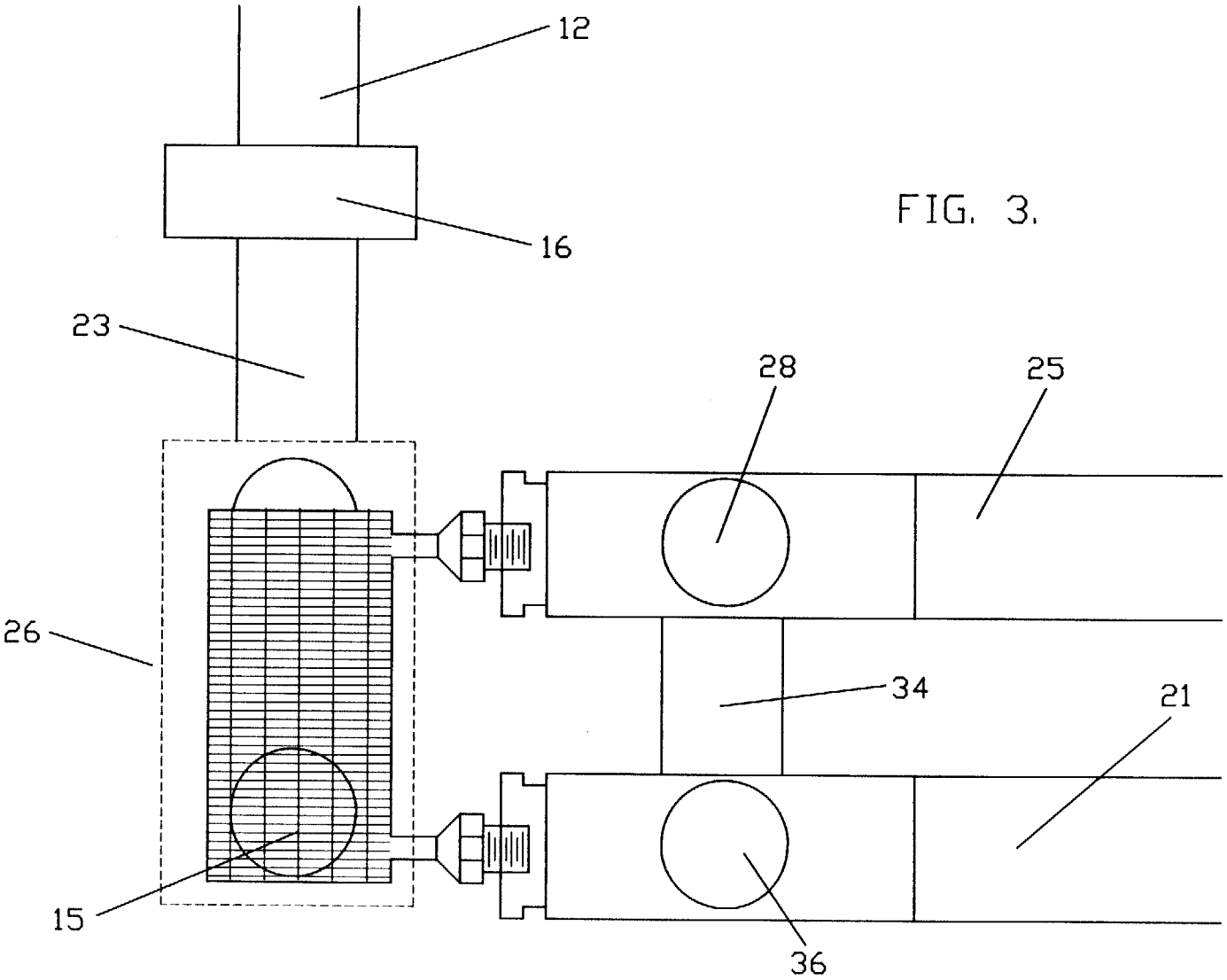
FIG. 3 is a side schematic view of the illustration of FIG. 2.

With further reference to FIGS. 2 and 3, the hot water circuit segment 25 to the fluid transfer coil (not shown) within heat exchanger 14 is provided by the hot water circuit. More particularly, hot water segment 25 provides an input to an upper fluid joint 28 which splits the water flow between channel 30, which enters said fluid transfer coil of the heated exchanger 14, and by-pass entrance 32, advancing downward through by-pass proper 34 to by-pass exit 32'. Further shown in FIGS. 2 and 3 is a lower fluid joint 36 which receives heated water input 30' from said fluid transfer coil and, in addition, receives by-pass channel output 32' from the by-pass 34. Lower fluid joint 36 flows into said hot water circuit segment 21 which advances to tub 10 to provide heated water thereto. As may be noted from the views of FIGS. 2 and 3, the passage of heated water through the fluid transfer coil of heat exchanger 14 will, through the action of the fins thereof, i.e., the heater sink of heater exchanger, cause the conveyance of heat from said fluid transfer coil to the air wihtin air closet 26, such that air exiting the air closet into internal air conduit 15 will be heated. Accordingly, bubbles 17 arriving from air conduit 15 will be heated to substantially the same temperature as that of water arriving from water circuit segment 21.

The heat exchanger and by-pass system shown herein may be readily modularized for purposes of a simple-to-effect retrofit of existing spa and tub systems.

Accordingly, while there has been shown and described the preferred embodiment of the present invention, it is to be understood that the invention may be embodied otherwise than is herein specifically shown and described and that within such embodiment certain changes may be made in the parts and arrangements thereof without departing from the underlying principles of this invention as set forth in the claims appended herewith.

Having thus described my invention, what I claim as new, useful and non-obvious and, accordingly secure by Letters Patent of the United States is:

1. A system in combination with a heated spa or tub for providing heated air bubbles to said heated spa or tub positioned within a heated water circuit having a pump means therein, the system comprising:

(a) an ambient air input conduit including blower means therein;

(b) a heat exchanger positioned within a air fluid integral closet, said heat exchanger having a central fluid transfer coil and heat sink means in thermal communication therewith, said heat sink means projecting outwardly into the interior of said air fluid closet, said air closet having as its input an output of said ambient air input conduit, said fluid transfer coil having as its input and output a by-pass of said heated water circuit; and (c) an internal air conduit having as its input the output of said air closet and, as its output, said spa or tub, whereby the passage of heated water from said by-pass through said fluid transfer coil will provide heat to said heat sink means which, in turn, will communicate heat to the ambient air furnished to said air closet thereby providing a heated air input to said internal air conduit and, at the output of said conduit, heated air bubbles to said spa or tub.

2. The system as recited in claim 1, comprising bubble generating means upon the output of said internal air conduit.

3. The system as recited in claim 1, further comprising heater means within said water circuit.

4. The system as recited in claim 1, in which said fluid transfer coil and heat sink define, in combination, a heat exchanger.

5. The system as recited in claim 3 in which said by-pass of said hot water circuit comprises:

an upper fluid joint downstream of said water heater, said joint bifurcated into (i) an input to said fluid transfer coil, and (ii) a by-pass of said fluid transfer coil; and a lower fluid joint at the output of said fluid transfer coil, said joint bifurcated into (i) an output to the downstream of said hot water circuit between said fluid transfer coil and said heated tub, and (ii) an input from the output of said by-pass of said upper fluid joint.

6. The system as recited in claim 5 in which said fluid transfer coil and said heat sink define, in combination, a heat exchanger.

* * * * *